US005509620A

United States Patent [19]

Crews

[11] Patent Number: 5,509,620

[45] Date of Patent: Apr. 23, 1996

[54] ROTATABLE REEL APPARATUS

[75] Inventor: Mitchell S. Crews, Geneva, Ill.

[73] Assignee: Stone Container Corporation, Chicago, Ill.

[21] Appl. No.: 60,583

[22] Filed: May 12, 1993

[51] Int. Cl.[6] ..... B65H 75/14

[52] U.S. Cl. ..... 242/608; 206/396; 242/610

[58] Field of Search ..... 242/71.8, 68.5, 242/68.0, 118, 608, 608.7, 610.1, 610.2, 610.3, 610; 206/395, 397, 408, 409

[56] References Cited

U.S. PATENT DOCUMENTS

| | | | |
|---|---|---|---|
| 710,774 | 10/1902 | Hales | 242/71.8 |
| 1,393,420 | 10/1921 | Ash et al. | 242/71.8 |
| 1,466,157 | 8/1923 | Byrne et al. | 242/608 |
| 1,560,120 | 11/1925 | Teed | 242/118.6 |
| 1,985,760 | 12/1934 | Baxenden et al. | 242/608 |
| 2,211,461 | 8/1940 | Gross | 242/71.8 |
| 3,059,763 | 10/1962 | Eifrid | 206/395 |
| 3,063,652 | 11/1962 | Bell | 242/71.8 |
| 3,145,823 | 8/1964 | Spradlin | 242/608 |
| 3,284,022 | 11/1966 | Eifrid | 242/608.7 |
| 3,342,435 | 9/1967 | Gelardi et al. | 242/71.8 |
| 3,389,872 | 6/1968 | Lyman | 242/71.8 |
| 3,454,155 | 7/1969 | Voissem et al. | 242/608.7 |
| 4,240,593 | 12/1980 | Bell et al. | 242/71.8 |
| 4,487,136 | 12/1984 | Beckway | 108/51.3 |
| 4,995,512 | 2/1991 | Liebel | 206/396 |

FOREIGN PATENT DOCUMENTS

| | | | |
|---|---|---|---|
| 866490 | 8/1941 | France | 242/608 |

OTHER PUBLICATIONS

Promotional two page brochure describing Stone Container Corporation's paperboard pallets, sold under the trademark "Cordeck." Approx. 1985–1986.

*Primary Examiner*—Daniel P. Stodola
*Assistant Examiner*—Eileen A. Dunn
*Attorney, Agent, or Firm*—Dick and Harris

[57] ABSTRACT

A rotatable reel apparatus for use in association with an axle and the like, for operably winding, storing, transporting and unwinding various windable materials. A core member, having an inner peripheral surface and an interior region, is operably sandwiched between a first and second corrugated paper platform member. The platform members include a spindle region, a plurality of core attachment flaps and a plurality of spaced apart apertures. Each of the apertures include distal edges and proximal edges wherein each of the proximal edges are operably positioned adjacent the peripheral surface of the core member, and each of the distal edges collectively serve to define the outer periphery of the spindle region. The core attachment flaps operably depend from each of the proximal edges of the spaced apart apertures and are folded inwardly toward, and into operable secured contact with, a corresponding portion of either the inner or outer peripheral surface of the core member. A concentrically positioned circular slot is integrally formed within the spindle region of each of the platform members to facilitate operable and aligned cooperation with, and rotation about the axle.

13 Claims, 1 Drawing Sheet

ROTATABLE REEL APPARATUS

BACKGROUND OF THE INVENTION

The present invention relates to reels, and, more particularly, to a rotatable reel apparatus for use in association with an axle and the like, for operably winding, storing, transporting and unwinding various windable materials.

Reels used in cooperation with an axle and the like have been known in the art for many, many years. Typically, such prior art reels have been constructed from relatively rigid material, such as plastic, wood and/or steel, wherein the platforms of the reel are either molded with, nailed or welded to the core portion of which the windable material is actually wound around. Although such prior art reels have been adequate from a functional standpoint, their deficiencies have resulted from their relatively heavy weight, expensive cost associated with their manufacture and replacement, and, in many cases, with respect to the potential pollutants which occur during their manufacture, as well as their potentially poor recyclable characteristics after such reels have been discarded.

Furthermore, although such prior art reels have been constructed with a core member sandwiched between a first and second platform, few, if any, of such prior art devices utilize platforms constructed from corrugated paper material which provides adequate structural integrity at a relatively low cost, and which, in addition to light weight, is environmentally desirable due to the recyclable nature of the material from which it is constructed. Additionally, although such prior art has disclosed attachment of the platforms to the top and bottom edges of the core member, few, if any, of such prior art devices teach, much less disclose, the use of a corrugated paper platform having integrally attached core attachment flaps which are inwardly folded from the platform from which they depend, toward, and into, operable contact with either the inner or outer peripheral surfaces of the core member to, in turn, provide operable securement of the platforms to the core member.

It is thus an object of the present invention to provide a rotatable reel apparatus which has its core member operably and securely sandwiched between first and second platform members which are constructed from a corrugated paper material.

It is also an object of the present invention to provide a rotatable reel apparatus wherein the first and second platform members include a plurality of core attachment flaps for operable securement to the inner peripheral surface of the core member, to, in turn, provide secured attachment of the respective platform member to the core member.

It is still further an object of the present invention to provide a rotatable reel apparatus which is relatively light and inexpensive to manufacture, and which is environmentally desirable during manufacture, and, after eventual discarding of same.

These and other objects will become apparent in light of the present Specification, Claims and Drawings.

SUMMARY OF THE INVENTION

The present invention comprises a rotatable reel apparatus for use in association with an axle and the like, for operably winding, storing, transporting and unwinding various windable materials such as rope, string, wire and film.

Core means are provided for operably receiving and maintaining the windable material thereabout. The core means, which may be constructed from a paper material, includes a top edge, a bottom edge opposite the top edge, an inner peripheral surface extending between the top and bottom edges, an interior region adjacently formed within the inner peripheral surface, and an outer peripheral surface for operable contact with at least a portion of the windable material upon the receipt and maintenance thereof.

First and second platform means, which may have a substantially circular configuration, are operably attached adjacent to a corresponding one of the top and bottom edges of the core means so as to sandwich the core means, and in turn, the windable material positioned about the core means, therebetween. Each of the first and second platform means are constructed from a corrugated paper material having an interior surface, an exterior surface opposite the interior surface, and an outer periphery greater than the outer peripheral surface of the core means. Each of the first and second platform means include a plurality of operably positioned core attachment flap means which are integrally formed in, and inwardly folded from, each of the first and second platform means. Accordingly, the inwardly folded orientation of the flap means enable the first and second platform means to be operably secured to at least a portion of at least one of the inner and outer peripheral surfaces of the core means.

The plurality of integrally formed and inwardly folded core attachment flap means result in a plurality of spaced apart apertures in the first and second platform means. Each of such spaced apart apertures include a proximal edge adjacent at least one of the inner and outer peripheral surfaces of the core means, and a distal edge. The distal edges serve to collectively define the outer periphery of a the spindle region which is substantially concentrically oriented with respect to the corresponding first and second platform means.

Spindle attachment means are operably positioned within each of the spindle regions of each of the first and second platform means at the centers thereof respectively. The spindle attachment means, which may comprise a substantially circular aperture, of each of the spindle regions are operably aligned with each other and positioned adjacent the interior region of the core means so as to facilitate operable cooperation with, and rotation about, the axle.

In the preferred embodiment of the invention, the rotatable reel apparatus further includes securement means operably associated with at least one of the inner and outer peripheral surfaces of the core means and each of the core attachment flap means of the first and second platform means. Such securement means serve to operably secure each of the core attachment flap means, and, in turn, the first and second platform means, to the core means.

In this embodiment of the invention, the securement means may additionally be operably associated with the top and bottom edges of the core means and a corresponding portion of the interior surfaces of the first and second platform means so as to provide enhanced securement of the first and second platform means to the core means. It is contemplated that the securement means comprise conventional adhesive, such as glue.

In another preferred embodiment of the invention, at least one of the first and second platform means further includes strengthening means for increasing the structural rigidity and compressibility of a corresponding one of the first and second platform means. The strengthening means may comprise at least one of the first and second platform means having two or more corrugated layers of paper material.

Furthermore, it is also contemplated that each of the layers of the corrugated paper material of the first and second platform means be constructed from a liner board corrugated medium having an inner liner board layer, an outer liner board layer and a fluted corrugated medium material adhesively sandwiched therebetween. Accordingly, when multiple layers of such corrugated medium are used for purposes of strengthening the structural integrity of the first and second platform means, each of such layers used may have their respective fluted portions in substantially parallel alignment with each other, or, alternatively, such fluted portions of each layer may be operably positioned in non-parallel alignment with each other.

In the preferred embodiment of the invention, the rotatable reel apparatus further includes at least one material engagement slot means integrally formed in at least one of the first and second platform means for operably receiving and releasably maintaining a lead portion of the windable material upon initial winding of same about the outer peripheral surface of the core means.

DETAILED DESCRIPTION OF THE INVENTION

Figure 1:
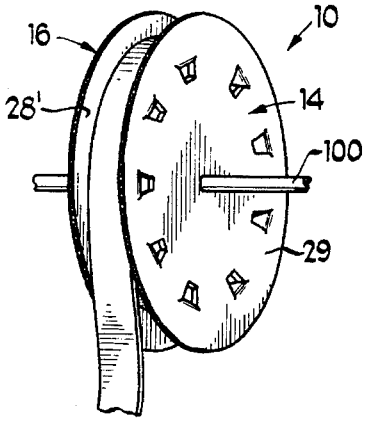
FIG. 1 is a perspective view of the rotatable reel apparatus showing, in particular, operable cooperation of spindle attachment means about an axle, and, the windable material substantially wrapped around the core means and, in turn, being sandwiched between the first and second platform means.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Figure 2:
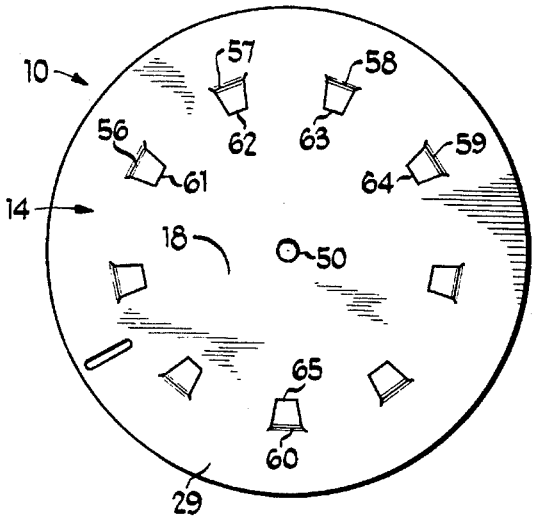
FIG. 2 of the drawings is a top plan view of the rotatable reel apparatus showing, in particular, the spaced apart apertures of the first platform means, the spindle region defined by the collective distal edges of the apertures, the concentrically positioned spindle attachment means, and, the material engagement slot means.
Figure 3:
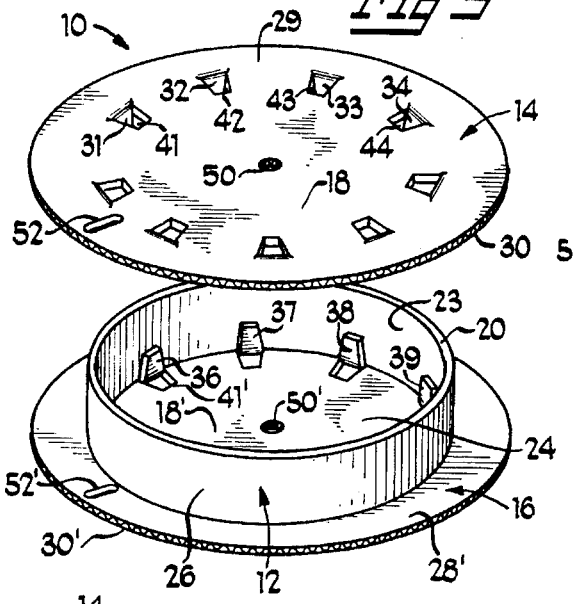
FIG. 3 of the drawings is a partially exploded perspective view of the rotatable reel apparatus showing, in particular, the operable attachment of the inwardly folded core attachment flap means of the second platform means to the inner peripheral surface of the core means, and, in turn, the spaced apart apertures from which the core attachment flap means depend.

Rotatable reel apparatus 10 is shown in FIGS. 1 through 3 as including core means 12 (FIG. 3), first platform means 14 and second platform means 16 (FIG. 1 and FIG. 3). Core means 12, which is operably sandwiched between first and second platform means 14 and 16, respectively, is shown in FIG. 3, as including top edge 20, bottom edge 21 (FIG. 5), inner peripheral surface 23, interior region 24 and outer peripheral surface 26.

Figure 4:
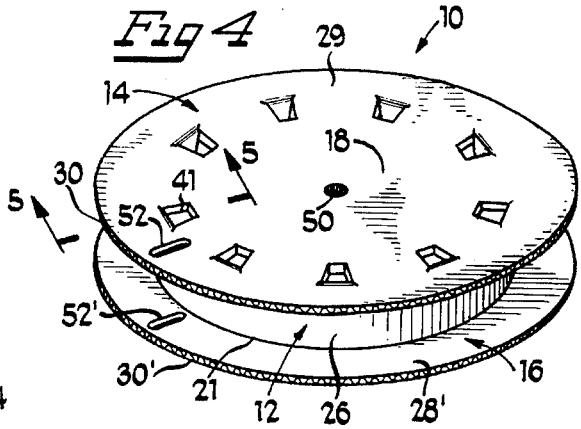
FIG. 4 of the drawings is a perspective view of the rotatable reel apparatus showing, in particular, the sandwiched positioning of the core means between the first and second platform means.

First and second platform means 14 and 16, respectively, are shown in FIG. 4, as each including an interior surface 28, 28' (FIG. 5), an exterior surface 29, 29', an outer periphery 30, 30', a plurality of core attachment flap means, such as core attachment flap means 31 through 34 of first platform means 14, and core attachment flap means 36 through 39 of second platform means 16 (FIG. 3), a corresponding number of spaced apart apertures, such as spaced apart apertures 41 through 45 of first platform means 14 (FIG. 3), a spindle region 18, 18' spindle attachment means 50, 50' and material engagement slot means 52, 52'. Material engagement slot means 52, 52' which are shown as having rectilinear configurations, extend all the way through the respective first and second platform means, and serve to operably receive and releasably maintain a lead portion of windable material, such as windable material 100 (FIG. 1) which is to be operably wound around outer peripheral surface 26 of core means 12.

Figure 6:
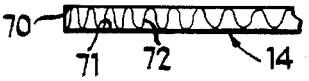
FIG. 6 of the drawings is a cross-sectional view of a single layer platform means constructed from liner board corrugated medium showing, in particular, the inner liner board layer, the outer liner board layer, and the fluted corrugated material sandwiched therebetween.
Figure 7:
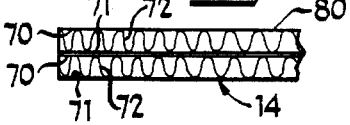
FIG. 7 of the drawings is a cross-sectional view of a double layer platform means wherein each layer is constructed from liner board corrugated medium.
Figure 8:
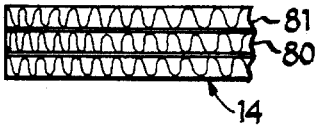
FIG. 8 of the drawings is a cross-sectional view of a triple layer platform means wherein each layer is constructed from liner board corrugated medium.

First and second platform means 14 and 16 are constructed from a corrugated paper material, such as a liner board corrugated medium, as shown in FIGS. 6 through 8, of the type comprising an inner liner board layer 70, an outer liner board layer 71 and a fluted corrugated material 72 sandwiched therebetween. In addition, for purposes of increasing the structural integrity of first and second platform means 14 and 16, respectively, it is also contemplated that either one, or both, of the first and second platform means be constructed from multiple layers of such corrugated paper material 80 and 81 (as shown in FIGS. 7 and 8, respectively). Such additional layer S can be constructed without apertures so that when they are operably attached to exterior surface, such as exterior surface 29, of platform means, such as platform means 14, they will completely cover each of the spaced apart apertures of the underlying layer; while maintaining operable exposure, and accordingly access to, each respective spindle attachment means 50, 50' and material engagement slots 52, 52' (FIG. 3) of first and second platform means 14 and 16, respectively. Although each of the layers which comprise the platform means (whether a single or multi-layer construction) are shown as comprising liner board corrugated medium, it is additionally contemplated that other types of conventional corrugated medium be used; including such medium wherein the inner and outer liner board may be fabricated from Kraft paper and/or grease proof paper, among others.

Spaced apart apertures, such as spaced apart apertures 41 through 45 of first platform means 14 (FIG. 3), each include a proximal edge, such as proximal edges 56 through 60 (FIG. 2), and a corresponding number of distal edges, such as distal edges 61 through 65 (FIG. 3), respectively. As can be seen in FIG. 2, each of the proximal edges of the spaced apart apertures are operably positioned adjacent inner peripheral surface 23 (FIG. 3) of core means 12, and, each of the distal edges of the spaced apart apertures are operably positioned adjacent interior region 24 of the core means. In an alternative embodiment, the core flaps may be attached to the inner and outer, or solely the outer, peripheral surface of core means 12. In either embodiment, each of such distal edges collectively serve to define the outer periphery of the spindle regions, such as spindle region 18, of a respective platform means.

Figure 5:
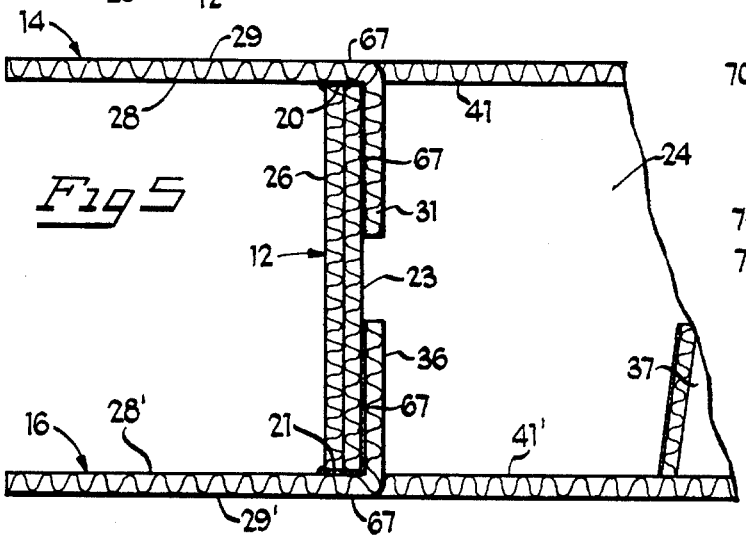
FIG. 5 of the drawings is a cross-sectional view of the rotatable reel apparatus, taken along lines 5—5 of FIG. 4, and looking in the direction of the arrows, showing, in particular, the securement means operably applied between the core attachment flap means and, in this embodiment, the inner peripheral surface of the core means. Also shown are securement means operably positioned between the interior surfaces of the first and second platform means and the top and bottom edges, respectively, of the core means; with FIG. 5 further showing the aligned positioning of the spaced apart apertures, and, in turn, the core attachment flap means in the first platform means with those in the second platform means.

Core attachment flap means, such as core attachment flap means 31 through 34 of first platform means 14, and, core attachment flap means 36 through 39 of second platform means 16, are shown in FIG. 3, as being integrally dependent from a corresponding proximal edge of a respective one of the spaced apart apertures. Each of such core attachment flap means are inwardly folded toward and into operable contact with either inner peripheral surface 23 or outer peripheral surface 26 of core means 12 for purposes of providing secured attachment of the corrugated paper platform means thereto. As shown in FIG. 5, such secured attachment of each of the core attachment flap means, and, in turn, the respective first and second platform means, to the core means, is accomplished through operable application of securement means 67 (such as adhesive), between each of the core attachment flap means, such as core attachment flap means 31, 36 and 37, and here, the adjacent region of contact of inner peripheral surface 23 of core means 12. Although securement means 67 can comprise conventional adhesive, such as glue, it is also contemplated that other types of conventional means to secure such corrugated paper attachment flap means to the core means; such as staples and/or rivets; be used.

Additionally, as can be seen in FIG. 3, each of the core attachment flap means have a trapezoid-shaped configuration which substantially conforms to the shape of the spaced apart apertures from which they depend; although other configurations, besides trapezoidal, are also contemplated. Furthermore, although not shown in detail, the preferred embodiment has a corresponding number of core attachment flaps and spaced apart apertures wherein each of the spaced apart apertures, such as aperture 41 (FIG. 5) in first platform means 14, are in substantial alignment with the spaced apart apertures, such as aperture 41 (FIG. 5) in second platform means 16.

Although securement of first and second platform means 14 and 16, respectively, to core means 12 is accomplished through operable cooperation between the core attachment flap means and inner peripheral surface 23 of the core means, additional securement is also contemplated so as to reduce the likelihood of inadvertently severing one, or both, of the first and second platform means from the core means. Indeed, as shown in FIG. 5, such additional securement can be accomplished by operably applying adhesive 67, or the like, between interior surfaces 28 and 28' of first and second platform means 14 and 16, respectively, and the corresponding top edge 20 and bottom edge 21 of core means 12. It is contemplated that such additional securement consist of operably applying adhesive either to the entirety of the top and bottom edges of the core means, or merely at various spaced apart, spotted regions.

Spindle attachment means 50, 50' are shown in FIG. 3 as comprising substantially circular apertures concentrically positioned within a respective spindle region 18, 18' of first and second platform means 14 and 16. Although not shown in detail, circular apertures 50, 50' are operably aligned with each other and positioned adjacent interior region 24 of core means 12, so as to facilitate operable cooperation with, and rotation about, axle 100, as shown in FIG. 1. Furthermore, although the spindle attachment means, as well the core means and the first and second platform means, are each shown as having a substantially circular configuration, other configurations, such as hexagonal, octagonal or even rectangular, among others, are also contemplated.

The foregoing description and drawings merely explain and illustrate the invention and the invention is not limited thereto except insofar as the appended claims are so limited, as those skilled in the art who have the disclosure before them will be able to made modifications and variations therein without departing from the scope of the invention.

What is claimed is:

1. A rotatable reel apparatus for use in association with an axle for operably winding, storing, transporting and unwinding various windable materials said rotatable reel apparatus comprising:

core means for operably receiving and maintaining said windable material thereabout, said core means having a top edge, a bottom edge opposite said top edge, an inner peripheral surface extending between said top and bottom edges, an interior region adjacently positioned to said inner peripheral surface, and an outer peripheral surface for operable contact with at least a portion of said windable material upon said receiving and maintaining thereof;

first and second platform means for precluding said windable material from inadvertently migrating beyond said top and bottom edges of said core means, each of said first and second platform means being operably attached adjacent to a corresponding one of said top and bottom edges of said core means so as to sandwich said core means, and in turn, said windable material positioned about said core means, therebetween, each of said first and second platform means being constructed from a corrugated paper material having an interior surface, an exterior surface opposite said interior surface, and an outer periphery greater than the outer peripheral surface of said core means;

each of said first and second platform means including a plurality of operably positioned core attachment flap means integrally formed in each of said first and second platform means and folded inwardly therefrom, for operably and restrainably securing each of said first and second platform means to at least a portion of at least one of said inner or outer peripheral surfaces of said core means, wherein at least one of said plurality of integrally formed and inwardly folded core attachment flap means in each of said first and second platform means are secured to said core means, said plurality of integrally formed and inwardly folded core attachment flap means resulting in a plurality of spaced apart apertures in said first and second platform means wherein at least one of said plurality of spaced apart apertures is formed by the inward folding of the corresponding core attachment flaps means, and wherein each of said spaced apart apertures includes a proximal edge adjacent said at least one of said inner or outer peripheral surfaces of said core means and a distal edge, said distal edges serving to collectively define the outer periphery of a spindle region substantially concentrically oriented with respect to said corresponding first and second platform means;

spindle attachment means for cooperation with said axle, said spindle attachment means being operably and respectively positioned within each of said spindle regions in a substantially co-planar orientation with each of said first and second platform means at the centers thereof respectively, said spindle attachment means of each of said spindle regions of each of said first and second platform means being operably aligned with each other and positioned adjacent said interior region of said core means so as to facilitate operable cooperation with, and rotation about, said axle.

2. The apparatus according to claim 1 further comprising securement means operably associated with said top and bottom edges of said core means and a corresponding portion of said interior surfaces of said first and second platform means for providing enhanced securement of said first and second platform means to said core means.

3. The apparatus according to claim 2 wherein said securement means comprises adhesive.

4. The apparatus according to claim 1 wherein at least one of said first and second platform means further includes strengthening means for increasing structural integrity of a corresponding one of said first and second platform means.

5. The apparatus according to claim 4 wherein said strengthening means comprises at least one of said first and second platform means having two or more corrugated layers of paper material.

6. The apparatus according to claim 1 wherein said corrugated paper material of each of said first and second platform means comprises corrugated liner board medium, said corrugated liner board medium comprising an inner liner board layer, an outer liner board layer and a fluted corrugated medium material adhesively sandwiched therebetween.

7. The apparatus according to claim 1 wherein said spindle attachment means comprises a substantially circular aperture for operable cooperation with, and rotation about, said axle.

8. The apparatus according to claim 1 wherein each of said first and second platform means and said core means have a substantially circular configuration.

9. The apparatus according to claim 1 in which each of said core attachment flap means have a configuration substantially equivalent in shape to said corresponding ones of said spaced apart apertures from which they depend.

10. The apparatus according to claim 1 in which each of said spaced apart apertures have a substantially trapezoid-shaped configuration.

11. The apparatus according to claim 1 in which each of said plurality of integrally formed and inwardly folded core attachment flap means have a substantially trapezoid-shaped configuration.

12. The apparatus according to claim 1 wherein the rotatable reel apparatus further includes at least one material engagement slot means integrally formed in at least one of said first and second platform means for operably receiving and releasably maintaining a lead portion of said windable material upon initial winding of same about said outer peripheral surface of said core means.

13. The apparatus according to claim 1 wherein said core means is constructed from a paper material.

* * * * *

UNITED STATES PATENT AND TRADEMARK OFFICE

CERTIFICATE OF CORRECTION

PATENT NO. : 5,509,620

DATED : April 23, 1996

INVENTOR(S) : Mitchell S. Crews

It is certified that error appears in the above-indentified patent and that said Letters Patent is hereby corrected as shown below:

| | |
|---|---|
| Col. 4, Line 54 | After "layers" insert -- 80 and 81 (as shown in Figs. 7 and 8, respectively) --. |
| Col. 4, Line 55 | After "material" delete -- 80 and 81 (as shown in Figs. 7 and 8, respectively) --. |
| Col. 4, Line 56 | Delete "layer S" and insert instead -- layers --. |
| Col. 7, Line 1 | Delete "flaps" and insert instead -- flap --. |

Signed and Sealed this

Twenty-first Day of January, 1997

*Attest:*

*Attesting Officer*

BRUCE LEHMAN

*Commissioner of Patents and Trademarks*